US009721433B2

(12) United States Patent
Badalyan et al.

(10) Patent No.: US 9,721,433 B2
(45) Date of Patent: Aug. 1, 2017

(54) METHODS AND SYSTEMS FOR GENERATING A LOTTERY TICKET

(71) Applicant: Vivaro Ltd., San Gwann (MT)

(72) Inventors: Vigen Badalyan, Yerevan (AM); Vahe Badalyan, Yerevan (AM)

(73) Assignee: Vivaro Ltd., San Gwann (MT)

( * ) Notice: Subject to any disclaimer, the term of this patent is extended or adjusted under 35 U.S.C. 154(b) by 361 days.

(21) Appl. No.: 14/578,838

(22) Filed: Dec. 22, 2014

(65) Prior Publication Data

US 2016/0005259 A1 Jan. 7, 2016

(30) Foreign Application Priority Data

Jul. 2, 2014 (GB) ..... 1411814.5
Sep. 8, 2014 (GB) ..... 1415855.4

(51) Int. Cl.
*G07F 17/32* (2006.01)

(52) U.S. Cl.
CPC ..... *G07F 17/329* (2013.01); *G07F 17/32* (2013.01); *G07F 17/3262* (2013.01)

(58) Field of Classification Search
USPC ..... 463/17
See application file for complete search history.

(56) References Cited

U.S. PATENT DOCUMENTS

2012/0264495 A1* 10/2012 Amaitis ..... G07F 17/3267 463/10
2013/0012288 A1* 1/2013 Nordby ..... A63F 3/0605 463/17
2013/0017880 A1* 1/2013 Fisk ..... G07F 17/32 463/19
2013/0260857 A1* 10/2013 Nordby ..... G07F 17/329 463/17

* cited by examiner

*Primary Examiner* — Pierre E Elisca
(74) *Attorney, Agent, or Firm* — Perkins IP Law Group LLC; Jefferson Perkins

(57) ABSTRACT

A method of generating a lottery ticket comprises the steps of: providing a succession of selection stages; providing for each stage two or more selection options; said selection options comprising a selection area which in response to a lottery player's interaction reveals either a winning or a losing indicator; wherein for each stage at least one of the selection options is a winning selection and at least one of the options is a losing selection.

6 Claims, 6 Drawing Sheets

METHODS AND SYSTEMS FOR GENERATING A LOTTERY TICKET

FIELD OF THE INVENTION

The invention relates to methods and systems for generating a lottery ticket. The invention also relates to methods of playing a game.

BACKGROUND TO THE INVENTION

In the field of lotteries and games there is a need to provide technical improvements in the efficiencies of delivery of the player/system interface. With lottery games increasingly being digitised in order to increase the rate of interaction of existing and new players, the flexibility of the lottery access platforms and the perceived potential levels of winnings need to be improved. A number of technical advances are outlined in the following section which not only achieve commercial benefits of presenting an enjoyable player interface but overcome a number of drawbacks present in traditional platforms.

SUMMARY OF THE INVENTION

In a first broad independent aspect, the invention provides a method of generating a lottery ticket comprising the steps of: providing a succession of selection stages; providing for each stage two or more selection options; the selection options comprising a selection area which in response to a lottery player's interaction reveals either a winning or a losing indicator; wherein for each stage at least one of the selection options is a winning selection and at least one of the options is a losing selection.

This method efficiently provides in certain embodiments an interactive ticket with a winning potential.

In a subsidiary aspect, the method further comprises the step of providing in association with one or more of the selection stages at least one further option which is selectable after revealing a losing selection; whereby either a further winning or a further losing selection is revealed. In particular embodiments, this method allows a player to have an additional chance of winning even if the player loses during a particular stage.

In a further subsidiary aspect, the method further comprises the step of associating a winning selection with a monetary value and presenting the options of either cashing in the monetary value or offering the ticket for purchase by one or more other lottery players. This configuration reverses conventional thinking by allowing the transfer of the potential value in a ticket through a mechanism which may involve a plurality of other players.

In a further subsidiary aspect, the method further comprises the step of presenting each selection stage in either a column or a row of a table with each column or row having two or more cells at least one of which is a predetermined winning cell and at least one is a predetermined losing cell. This tabular form improves the stagewise configuration of the lottery whilst allowing a player to clearly identify and for the system to better record a player's interaction with the system.

In a further subsidiary aspect, the method further comprises the step of providing a timer and limiting the time for potential purchase of a ticket. This configuration will allow in certain embodiments for a player to sell a ticket within a specific timeframe and to monitor the remaining time for achieving a sale.

In a further subsidiary aspect, the method further comprises the step of presenting side-by-side a plurality of tables each having a succession of selection stages; whereby a player may select one or more of said tables. This provides a player with an additional level of choice where the odds of winning will potentially be different whilst their potential rewards may likewise vary. Nevertheless, irrespective of which table is selected by a player, each stage (line or column) may include a winning possibility.

In a further subsidiary aspect, the content of each cell of a selection stage is randomly selected provided at least one of the cells is a winning cell and at least one of the cells is a losing cell. This allows appropriate probability theory and algorithms to be employed in order to provide sufficiently motivating wins for players whilst the randomly disposed losing and winning positions will on average provide a net profit to the lottery organiser.

In a subsidiary aspect, the tables have a number of cells per selection stage which are selected from the group comprising two, three or four. This method provides flexibility and choice for a player in order to increase interest in the interaction with the lottery.

In a second broad independent aspect, the invention provides a system for generating a lottery ticket comprising a processor for generating a plurality of matrices; each matrix having a plurality of individual values which are distributable in a column and row format; wherein either a column or a row of matrices contains both a value which is indicative of a losing selection and a value which is indicative of a winning selection; a player interface for displaying in a player understandable format a further matrix which initially shows neither a winning selection nor a losing selection; said processor being equipped to drive a module for initially presenting the further matrix and thereafter for causing a change in the display of an area of the matrix in response to the recordal of a player's interaction; the module causing thereafter the display of either a winning or a losing selection; wherein each column or each row of the displayed matrix necessarily has at least one winning selection and at least one losing selection. This system is particularly advantageous because it allows a mathematically controlled framework to be employed which may be scalable. It also allows the system to be implemented in certain embodiments on a display unit such as a personal digital assistant (computer pads, mobile phones, workstations, game consoles). It is particularly advantageous since it lends itself, in certain embodiments, to tactile user or player interaction. Due to the recordal of a player's interaction there is also enhanced traceability and accountability. The provision of the winning and losing selections in a column and row format may also allow a processor to readily identify values and translate these into monetary values of one or more preferred currencies.

In a subsidiary aspect, said further matrix comprises an initial row N and an initial column M; and a locking mechanism for preventing interaction with either row N+1 or column M+1 whilst no interaction has been recorded with either row N or column M; and for permitting interaction with either row N+1 or column M+1 only if a winning selection has been recorded. This controls the potential stagewise (row-by-row or column-by-column) interaction with the displayed matrix. This also reverses conventional thinking concerning traditional locking mechanisms where these generally only rely on a predetermined visible interaction location on the tactile screen of a player's interface.

In a further subsidiary aspect, the locking mechanism incorporates a tactile input surface where only the interaction of a winning selection in one of a row N, a column M or a specifically designated cell, unlocks a subsequent row N+1 or column M+1. This configuration provides an advantageous unlocking mechanism which allows access to further stages such as a column or a row for only those who have won a particular stage.

In a further subsidiary aspect, the locking mechanism relies on the selection of a particular random cell on a predetermined row or column. The provision of a random cell as an integral part of the locking mechanism may in certain embodiments facilitate a new and non-obvious approach to the successful unlocking of a player's interface.

In a further subsidiary aspect, the locking mechanism may not be reset other than by purchasing a further matrix from a database of predetermined matrices. This allows for the unlocking mechanism to proceed only for winning selections and thereafter allow a renewal of the locking mechanism provided a further matrix is purchased from a database of predetermined matrices. This also provides an increase in accuracy and in the logging of a player's interaction with the system.

In a further subsidiary aspect, the system further comprises a timer and a countdown module which is activated once an initial selection in either row N or column M has been attempted by a player, and said locking mechanism prevents interaction with a further row or column if either time has run out or a losing selection has been recorded for row N or column M. This provides for a limited interaction window as an extra level of efficiency and game security, preventing, in particular, decryption of the ticket.

In a further subsidiary aspect, the locking mechanism responds to the interaction with one of a further row, a further column or a specifically designated cell if a winning selection is recorded in a separate location of the matrix provided such a location is associated with the row N or column M in question. This allows an escape route for certain stages of interaction where a further chance of unlocking a further stage may be provided.

In a further broad independent action, the invention provides a method of playing a game comprising the steps of: providing a succession of selection stages; providing for each stage two or more selection options; the selection options comprising a selection area which in response to a lottery player's interaction reveals either a winning or a losing indicator; wherein for each stage at least one of the selection options is a winning selection and at least one of the options is a losing selection; and a player interacts with a selection area of an initial stage to reveal either a winning or a losing indicator; whereby a player has a winning chance for each selection stage.

This method reverses conventional thinking by increasing the potential winning chance for individual players whilst providing a succession of selection stages where winning opportunities are present.

In a subsidiary aspect, the method further comprises the step of providing in association with one or more of said selection stages at least one further option which is selectable after revealing a losing selection; whereby either a further winning or a further losing selection is revealed; the player having the option of selecting the further option. This allows a player to have a further chance to win even in the event of a loss.

In a further subsidiary aspect, the method further comprises the step of associating a winning selection with a monetary value and presenting the options of either cashing in the monetary value or offering the ticket for purchase by one or more other lottery players; wherein a player either cashes in the monetary value or offers the ticket for purchase by one or more other players.

In a further subsidiary aspect, the method further comprises the step of presenting each selection stage in either a column or a row of a table with each column or row having two or more cells at least one of which is a predetermined winning cell and at least one is a predetermined losing cell.

In a subsidiary aspect, the method further comprises the step of providing a timer and limiting the time for potential purchase of a ticket.

In a further subsidiary aspect, the method further comprises the step of presenting side-by-side a plurality of tables each having a succession of selection stages; whereby a player may select one or more of said tables.

In a further subsidiary aspect, the content of each cell of a selection stage is randomly selected provided at least one of the cells is a winning cell and at least one of the cells is a losing cell.

In a further subsidiary aspect, the tables have a number of cells per selection stage which are selected from the group comprising two, three or four.

DETAILED DESCRIPTION OF THE FIGURES

Figure 1:
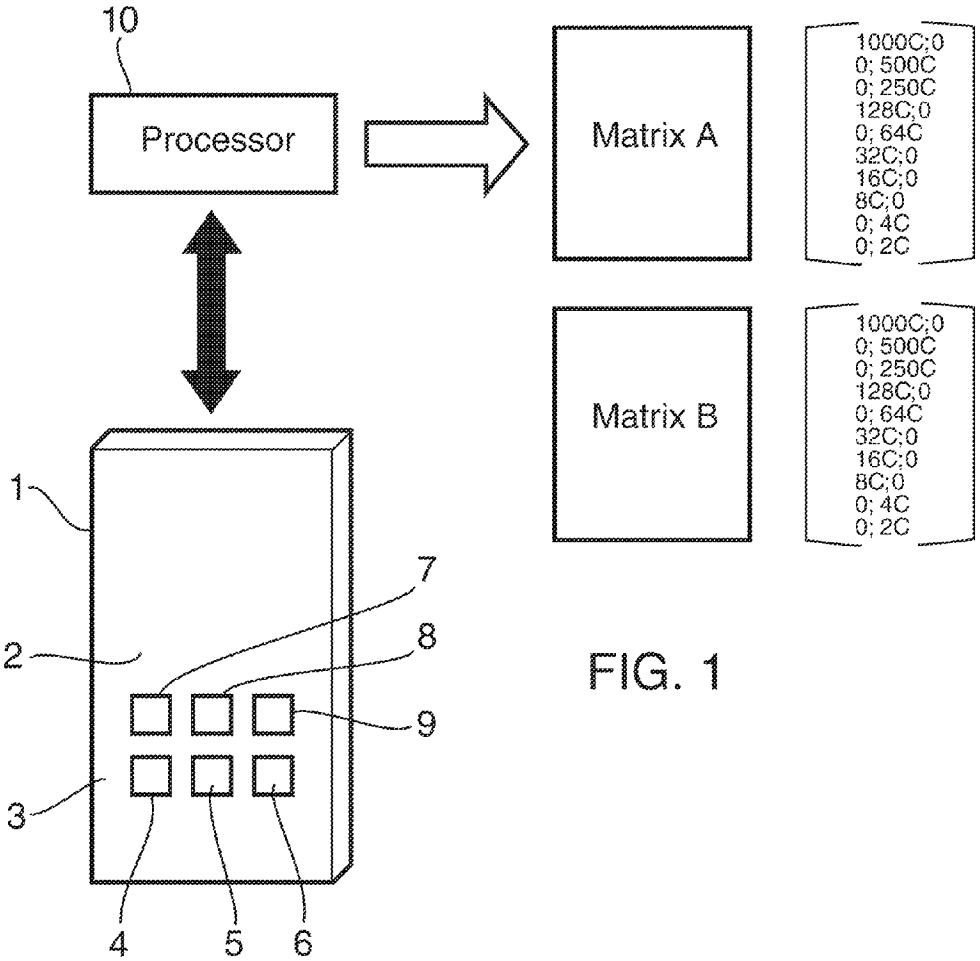
FIG. 1 shows a schematic view of a player's display unit and its potential remote interaction with a processor of a game.

FIG. 1 shows a player's display unit 1 with a tactile user input surface 2 such as a capacitive sensing display screen. A locking mechanism 3 is displayed as part of a lottery ticket. The locking mechanism relies on a number of cells disposed in a tabular or matrix configuration. In this embodiment, a first row of cells 4, 5 and 6 are presented below a second row of cells 7, 8 and 9. Initially, any interaction of a player with cell 7, 8 and 9 would not result in a recorded selection. The locking mechanism requires a player to initially select the correct cell of the first row. For example, if the winning cell is cell 5 and a player were to select cell 5 any interaction with cell 7, 8, and 9 would then be permitted by the system. Otherwise, if cells 4 and 6 are selected, a losing result would be obtained thus also preventing the unlocking of the further stage.

A processor 10 may be provided for generating a plurality of matrices such as matrix A and matrix B. As illustrated between square brackets, each matrix has preferably a plurality of individual values which are distributed in a column and row format. In the case of matrix A, for example, in the lowermost column, the values are 0 and 2 C. If matrix A were loaded into a ticket of the kind that will be described with reference to FIG. 2, the bottom row of the ticket would have (once revealed) either a 0 value or a 2 C value. In this embodiment, 0 would be a losing selection and 2 C would be a winning selection. The processor would record the particular column and row selected by the interaction of a player in order to identify which of the values in the bottom column a player has selected. If a player selects a winning selection such as 2 C then a monetary value may be derived based on 2 C and the player may progress to the next row. In the embodiment of matrix, a player has a 50/50 chance of winning at each stage. Other matrices may have an additional column which would reduce the likelihood of winning to one in three at each stage of the process. Once a selection of a player has been entered, the player interface is updated to reflect the value in the relevant matrix.

Figure 2:
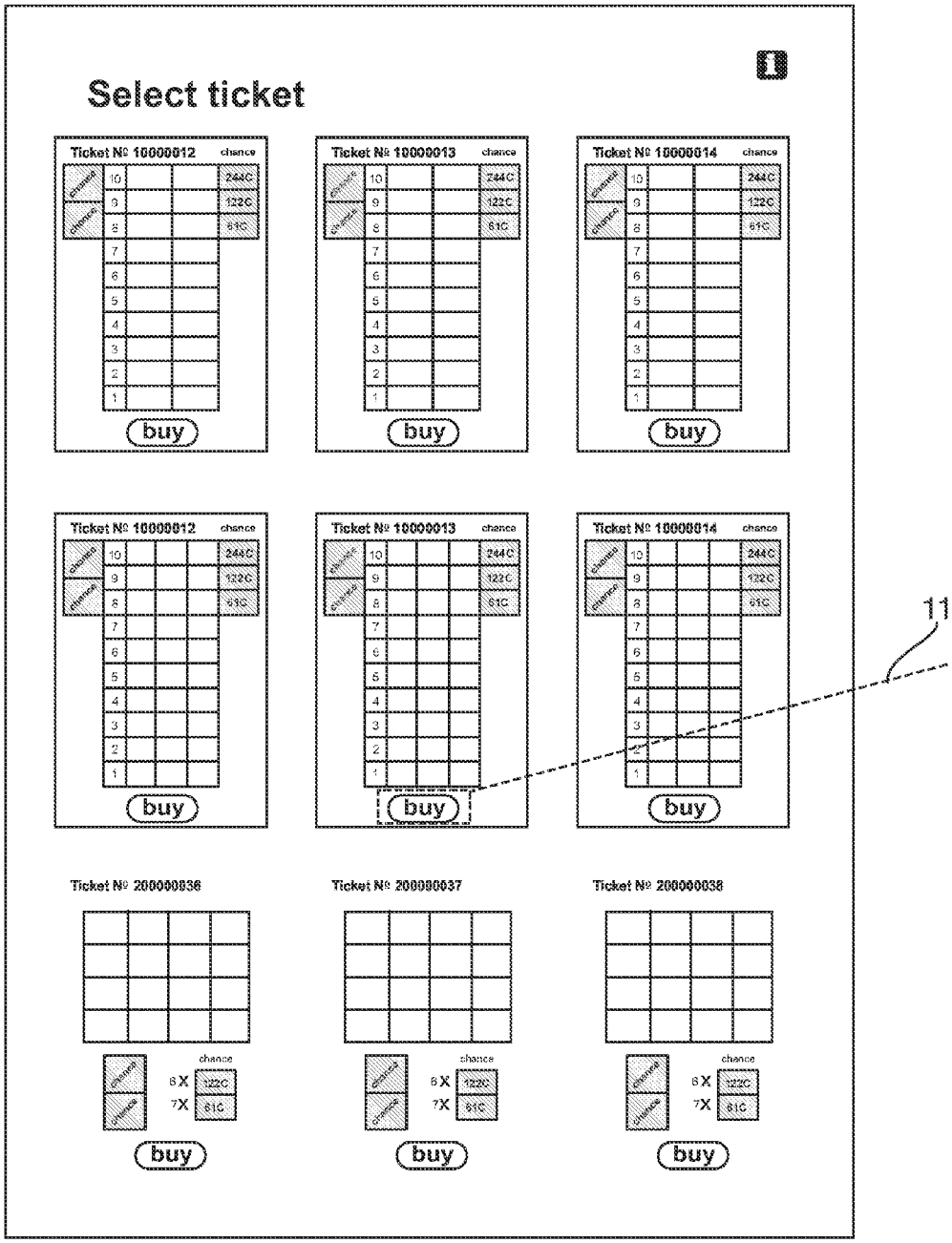
FIG. 2 shows a selection screen for a plurality of different tickets.
Figure 3:
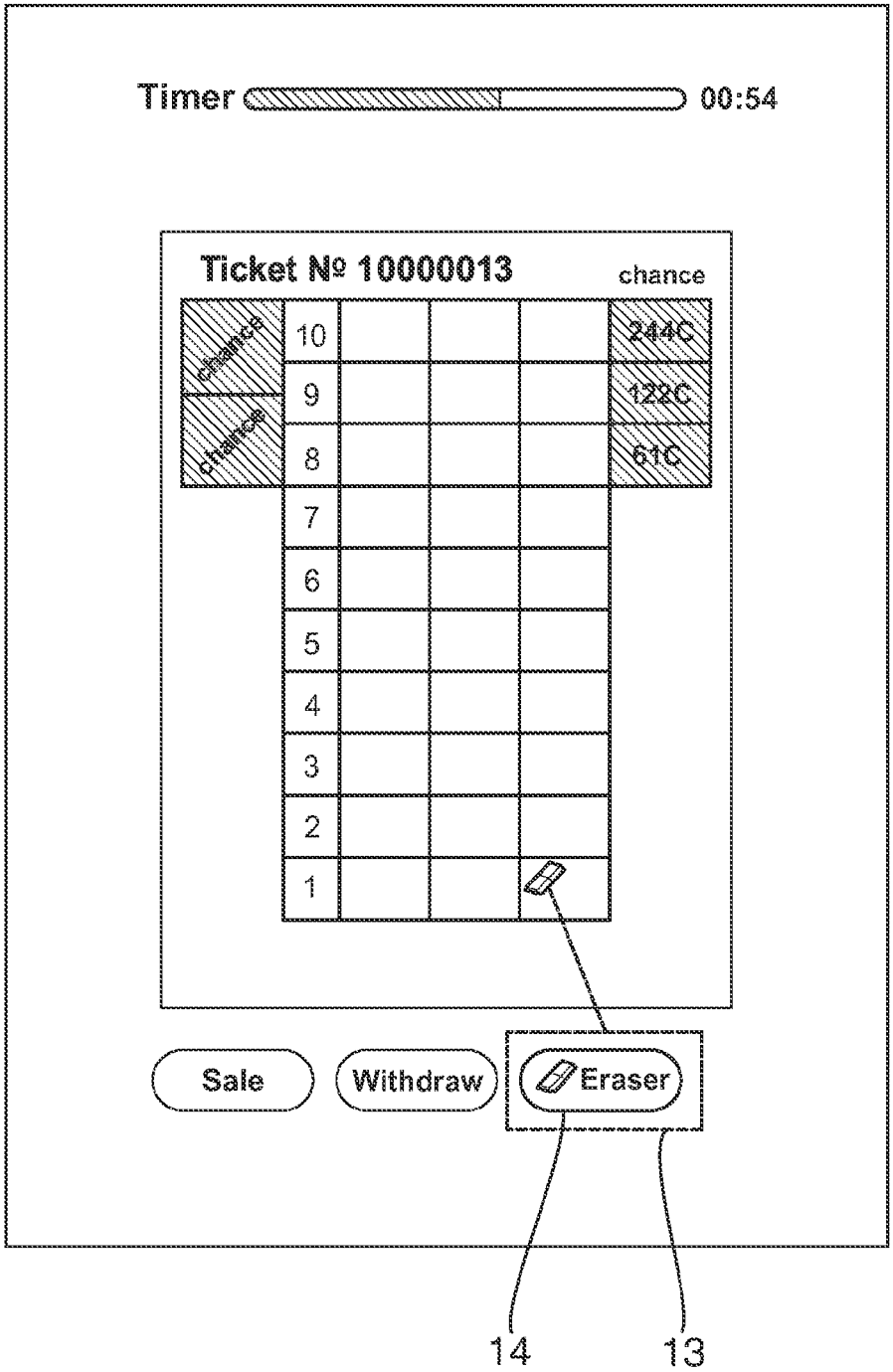
FIG. 3 shows the potential first stage of player interaction with an electronic ticket.
Figure 4:
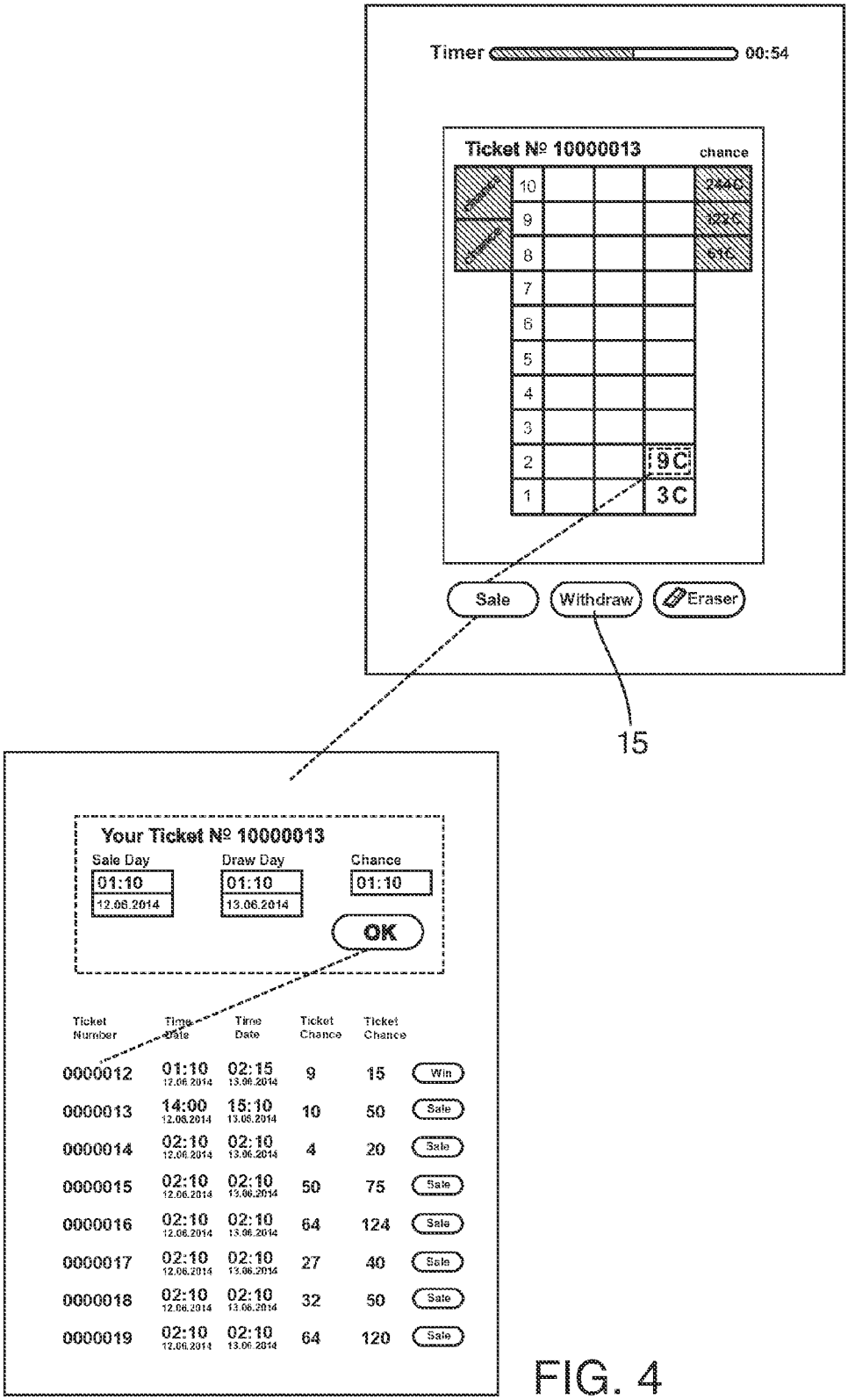
FIG. 4 shows a ticket with a winning first and second stage and with the associated sales portal.

FIG. 2 presents a potential player's view of nine individual tickets. A player may purchase one or more of these tickets. In the first row of tickets each ticket has ten rows and two columns, in the second row each ticket has ten rows and three columns, and in the third row of tickets each ticket has four rows and four columns. A player may buy for a different price any of these tickets where each row has at least one winning option. A dashed line 11 illustrates a potential interaction of a player when selecting ticket 13. Once ticket 13 is purchased a timer 12 is initiated. In this illustration the remaining time is fifty four minutes for a player to select initially one of the three available options in the bottom row of the ticket. Dashed lines illustrate a potential interaction of a player with an eraser 14. The eraser may be a virtual eraser which once located over a particular cell of the table may delete the grey section in order to reveal whether the selection was a winning or a losing selection. As shown in FIG. 4, the player has obtained a winning selection since the indicators 3 C and 9 C have been successively revealed. Having secured two wins in a row, the player may sell the ticket in an auction for example for 140 C. For the purposes of this description C may be an appropriate currency. Whilst the indicators of winning and losing are at least in part numeric, these may alternatively be alpha numeric or simply a symbol or image such as a tick as shown in FIGS. 5 and 6.

As another option instead of selling the ticket to another player, the winning player may cash in by pressing the withdrawal button 15 in the user or player interface.

Figure 5:
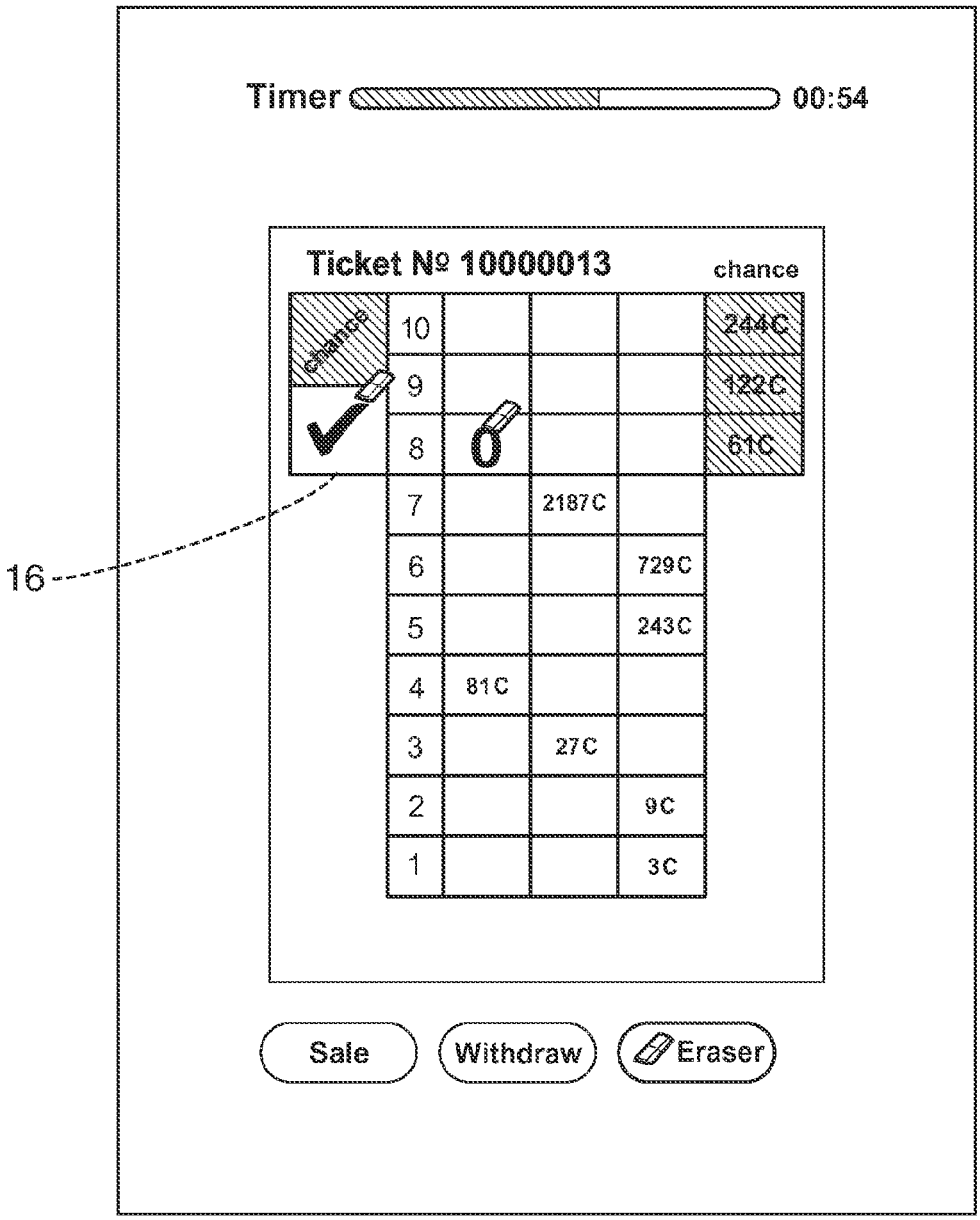
FIG. 5 shows a further embodiment of a ticket where a number of winning stages have been completed and a losing selection has been uncovered.

FIG. 5 further illustrates an embodiment of a ticket where the player has successfully achieved seven wins in a row and has now unfortunately selected a losing cell in the eighth row. At this stage, a player has a chance of continuing in the game by selecting the chance button 16 located on the side of the ticket. The chance may or may not be a further winning option. In this embodiment it allows the player to secure 61 C and potentially once again progress in the game to a further row 9.

Figure 6:
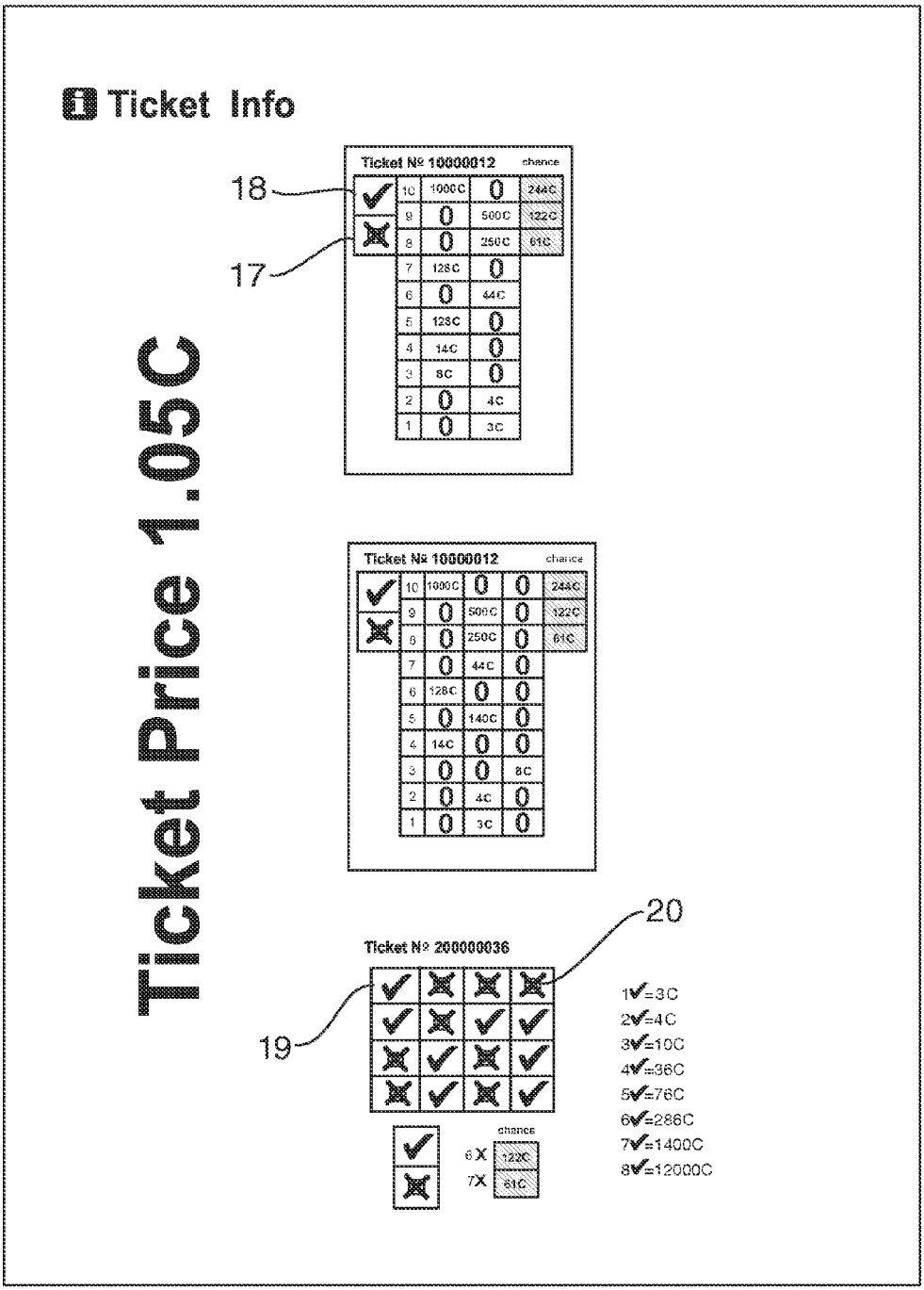
FIG. 6 shows a plurality of ticket formats where the winning or losing indicators have been revealed.

FIG. 6 shows three different kinds of tickets with each one of the cells being fully revealed. This illustrates that for each row there is at least one winning chance. For ticket 0000012 there are provided two chance buttons 17 and 18, button 17 is a losing selection whilst button 18 is a further winning selection.

Ticket number 20000036 employs indicators in the form of symbols such as tick 19 or red cross 20. The winning cell corresponds to tick 19 whilst the losing cell corresponds to red cross 20. Each one of the winning selections corresponds to a potential monetary value. The first and each subsequent tick 19 revealed correspond to an increasing prize value, and this value may be listed on an in situ correlation database 21, or elsewhere. In this embodiment of the invention, there is a chance area 22, which, when, having revealed a cross 20, gives the user an opportunity to win a prize of lesser value, if they reveal a positive symbol under the relevant portion of the chance area 22. In this embodiment of the invention, chances are given to users who revealed a negative symbol on their seventh or eighth choices.

Where the cost of play is 1.05 c, and there is a matrix of sixteen cells, of which eight are winning cells and eight are losing cells, revealing a first winning cell provides a prize of 2 C, revealing a second winning cell provides a prize of 4 C, revealing a third winning cell provides a prize of 10 C, revealing a fourth winning cell provides a prize of 24 C, revealing a fifth winning cell provides a prize of 76 C, revealing a sixth winning cell provides a prize of 286 C, revealing a seventh winning cell provides a prize of 1400 C and revealing an eighth winning cell provides a prize of 12000 C. The first portion of chance area 22, being a second chance if a negative seventh choice is made in the grid, yields a prize of 15 C, while the second portion of chance area 22, being a second chance if a negative eighth choice is made in the grid, yields a prize of 217 C. These values are given by way of example only, but are illustrative of a pricing strategy my which means profitability can be held in balance with profitability.

In any embodiment of the invention, a given monetary value in a cell may be substituted with a material good.

The protocols surrounding ticket generation embody a commitment scheme, which is to say a scheme which binds the generator in a given cell to either 1 or 0 (and to the other choice in one or more other cells), but without revealing the committed value until play ensues and the player selects a given cell or sequence of cells to reveal. Subsequent to play, by offering a player a key, it is possible to reveal to them which cells contained the losing and winning selections. By offering this option to reveal subsequent to play, the user is shown the positive and negative status of all cells, such that it is made apparent to the user the choices which would have led to a positive outcome. This serves to increase user trust in the system and to encourage further play.

In particularly preferred embodiments, the user is able to determine the number of rows formative of a matrix, such that that the user may choose any number of rows greater than two and less than a predetermined upper limit. Alternatively, there may be no upper limit. The chances of winning change in accord with a co-efficient, in order to ensure that the relationship between the size of the potential win and the odds of winning remain the same, and that the margin of profit built into each ticket also remains the same. Thus, where there are two rows, the multiplier of win to stake might be 1.9, with 3 rows, this might increase to 2.8, with 4 rows 3.7 and so on.

In some preferred embodiments, the player is able to set the initial price of the ticket. As the prizes for successful removal of appropriate grey sections are multipliers of the initial purchase price, the value of the prizes may be adjusted accordingly.

In one preferred mode of play, the user may play with a plurality of cards simultaneously. In this mode, the player selects an option to receive a plurality of cards which are or have been generated in the fashion already described. In order to progress from prize level n to prize level n+1, the player must make a winning selection on level n of each constituent card. Progress can be made by either selecting a grey section to erase from each card in a serial, time linear fashion, or alternatively all of the grey areas may be selected at a single time, for the simultaneous removal of all of the said grey areas at once. In this instance, the value of the prize for correct choices in all cards constitutive of a prize level is the prize which would be won for each individual card, multiplied together. For example, where the prize on a given level is 1.9×S, where S is the original stake, and there two cards, the prize will be 3.8×S (i.e 1.9×1.9×S). In theory, any multiplier may be possible, although in practice there may be an upper limit on the extent of the multiplier, in terms of there being made a maximum number of cards and/or rows available to the user.

Where a marketplace option is available, it is possible to combine cards bought from the marketplace with newly bought cards, such that different sums can be won. Cards combined in this way need not be identical—a card with 3 rows can be combined with a card with two rows, for example.

In particularly preferred embodiments, the player has control over the size of the stake, the number of rows and the number of cards utilised in a given sequence of plays and is thus able to combine the variables in order to select different magnitudes of prize to play for.

In each instance, a selection of options is made by the user, via an appropriate interface and the appropriate cards are subsequently either generated, or selected from a pre-generated store. Once generated or selected, they are put into play.

The invention claimed is:

1. A system for generating a lottery ticket comprising a processor for generating a plurality of matrices; each matrix having a plurality of individual values which are distributable in a column and row format; wherein either a column or a row of said matrices contains both a value which is indicative of a losing selection and a value which is indicative of a winning selection;

a player interface for displaying in a player understandable format a further matrix which initially shows neither a winning selection nor a losing selection;

said processor being equipped to drive a module for initially presenting said further matrix and thereafter for causing a change in the display of an area of said matrix in response to the recordal of a player's interaction; said module causing thereafter the display of either a winning or a losing selection;

wherein each column or each row of the displayed matrix necessarily has at least one winning selection and at least one losing selection, and wherein said further matrix comprises an initial row N and an initial column M; and a locking mechanism for preventing interaction with either row N+1 or column M+1 whilst no interaction has been recorded with either row N or column M; and for permitting interaction with either row N+1 or column M+1 only if a winning selection has been recorded.

2. A system according to claim 1, wherein said locking mechanism incorporates a tactile input surface where only the interaction of a winning selection in one of a row N, a column M or a specifically designated cell, unlocks a subsequent row N+1 or column M+1.

3. A system according to claim 2, wherein said locking mechanism relies on the selection of a particular random cell on a predetermined row or column.

4. A system according to claim 3, wherein said locking mechanism may not be reset other than by purchasing a further matrix from a database of predetermined matrices.

5. A system according to claim 1, further comprising a timer and a countdown module which is activated once an initial selection in either row N or column M has been attempted by a player, and said locking mechanism prevents interaction with a further row or column if either time has run out or a losing selection has been recorded for row N or column M.

6. A system according to claim 1, wherein said locking mechanism responds to the interaction with one of a further row, a further column or a specifically designated cell if a winning selection is recorded in a separate location of the matrix provided such a location is associated with the row N or column M in question.

* * * * *